US008884992B2

(12) United States Patent
Lee et al.

(10) Patent No.: US 8,884,992 B2
(45) Date of Patent: Nov. 11, 2014

(54) LIQUID CRYSTAL DISPLAY AND METHOD FOR COMPENSATING COLOR TEMPERATURE

(75) Inventors: Taewook Lee, Paju-si (KR); Hyoungsik Kim, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 193 days.

(21) Appl. No.: 12/829,194

(22) Filed: Jul. 1, 2010

(65) Prior Publication Data

US 2011/0157240 A1 Jun. 30, 2011

(30) Foreign Application Priority Data

Dec. 28, 2009 (KR) ..... 10-2009-0131978

(51) Int. Cl.

*G09G 5/10* (2006.01)
*G09G 3/36* (2006.01)
*G09G 3/34* (2006.01)

(52) U.S. Cl.

CPC ..... *G09G 3/3611* (2013.01); *G09G 3/3406* (2013.01); *G09G 2320/0626* (2013.01); *G09G 2320/0666* (2013.01)
USPC ..... 345/690; 345/88

(58) Field of Classification Search

CPC ..... H04N 9/3182; G09G 2320/0242; G09G 2370/08; G09G 3/3611; G09G 3/3406; G09G 2320/0666; G09G 2320/0626
USPC ..... 345/88, 690
See application file for complete search history.

(56) References Cited

U.S. PATENT DOCUMENTS

| | | | | |
|---|---|---|---|---|
| 6,081,254 | A * | 6/2000 | Tanaka et al. | 382/167 |
| 7,705,815 | B2 * | 4/2010 | Yun et al. | 345/89 |
| 7,956,923 | B2 * | 6/2011 | Oh | 348/333.12 |
| 2004/0263456 | A1 * | 12/2004 | Miyachi et al. | 345/88 |
| 2007/0091042 | A1 * | 4/2007 | Chung et al. | 345/88 |
| 2008/0117162 | A1 * | 5/2008 | Song et al. | 345/102 |
| 2010/0020193 | A1 * | 1/2010 | Zhang et al. | 348/223.1 |
| 2010/0171770 | A1 * | 7/2010 | Inoue et al. | 345/690 |
| 2012/0155763 | A1 * | 6/2012 | Zhang et al. | 382/167 |

FOREIGN PATENT DOCUMENTS

| | | | |
|---|---|---|---|
| CN | 1381035 | 11/2002 | |
| CN | 101188093 | 5/2008 | |
| JP | 2008233854 | * 10/2008 | G09G 2/30 |

* cited by examiner

*Primary Examiner* — Kwang-Su Yang
(74) *Attorney, Agent, or Firm* — McKenna Long & Aldridge LLP

(57) ABSTRACT

Disclosed is a liquid crystal display device and a method for compensating the color temperature of the liquid crystal display device. The timing controller according to the present disclosure, modulates the digital video data input from the host computer, compensates the shifted color temperature caused during the data modulation, and then sends the modulated and compensated digital video data to the data driving circuit.

4 Claims, 2 Drawing Sheets

LIQUID CRYSTAL DISPLAY AND METHOD FOR COMPENSATING COLOR TEMPERATURE

This application claims the benefit of Korea Patent Application No. 10-2009-0131978 filed on Dec. 28, 2009, which is incorporated herein by reference for all purposes as if fully set forth herein.

BACKGROUND OF THE INVENTION

1. Field of the Invention

The present disclosure relates to a liquid crystal display device (or "LCD") and a method for compensating the color temperature of the liquid crystal display device.

2. Discussion of the Related Art

An active matrix type liquid crystal display device (or "AMLCD") represents video data using the thin film transistor (or "TFT") as the switching element. As the AMLCD can be made in thin flat panel with lightening weight, nowadays in the display device market, it is replacing cathode ray tube (or "CRT") and applied to portable information appliances, computer devices, office automation appliances, and/or television sets.

The AMLCD comprises a data driving circuit for supplying the data signals to the data lines of the LCD panel, a gate driving circuit for sequentially supplying the gate pulse (or scan pulse) to the gate lines of the LCD panel, and a timing controller for controlling the operating timings of the data driving circuit and the gate driving circuit.

In order to improve the video quality and performance of the AMLCD, the AMLCD may further comprise the circuits for modulating the input video data or for tuning the color temperature of the video data. The AMLCD comprises an LCD module and a host computer. The LCD module includes an LCD panel, driving circuits of the LCD panel, a timing controller for controlling the operating timings of the driving circuits, a backlight unit, a backlight driving circuit for operating light sources of the backlight unit, and various case elements for assembling and housing these components. The host computer includes a graphic processing circuit for sending the input video data and the timing signals to the LCD module, and a power circuit for generating and supplying the power of the LCD module.

The host computer may further comprise a data modulating circuit for modulating the input video data, and a color temperature tuning circuit for optimizing the color temperature of the input video data. In addition, the LCD module may comprise an additional data modulating circuit for modulating the input video data. In this case, the color temperature of the video data represented on the LCD may be not matched with the color temperature optimally tuned by the host computer. This problem is caused by that the color temperature is fluctuated because the gray scale of the data is shifted when the video data is changed after tuning the color temperature.

SUMMARY OF THE INVENTION

In order to overcome the above mentioned drawbacks, the purpose of the present disclosure is to suggest a liquid crystal display device in which the color temperature is not fluctuated even if the input video data is modulated, and a method for compensating the color temperature.

In order to accomplish the above purpose, the present disclosure suggests a liquid crystal display device comprising: a liquid crystal display panel including a plurality of data lines and a plurality of gate lines crossing each other; a data driving circuit converting digital video data into positive and negative data voltages and supplying the positive and the negative data voltages to the plurality of data line; a gate driving circuit supplying a gate pulse to the plurality of gate line sequentially; and a host computer configured to tune a color temperature of the digital video data and to output timing signals and the digital video data having tuned color temperature; and a timing controller configured to send the digital video data input from the host computer to the data driving circuit, and to control operating timings of the data driving circuit and the gate driving circuit based on the timing signals.

The timing controller modulates the digital video data received from the host computer, compensates the color temperature of the digital video data having a shifted color temperature by the data modulating, and then sends the digital video data to the data driving circuit.

A method for compensating the color temperature of the liquid crystal display device according to the present disclosure comprises steps of tuning the color temperature of the digital video data input to a host computer and then outputting timing signals and the digital video data having the tuned color temperature; and modulating the digital video data input from the host computer, compensating a shifted color temperature at modulating the digital video data, and then sending the digital data to the data driving circuit.

According to the present disclosure, the color temperature is compensated after conducting all modulation processes at the host computer and the timing controller. Therefore, with just one step for the color temperature compensation, the shifted color temperature caused during the data modulation can be compensated.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Advantages and features of the present disclosure and a method of achieving the advantages and the features will be apparent by referring to embodiments described below in detail in connection with the accompanying drawings. Hereinafter, referring to drawings, some preferred embodiments of the present disclosure are explained in detail. However, the present disclosure is not restricted by these embodiments but can be applied to various changes or modifications without changing the technical spirit. In the following embodiments, the names of the elements are selected by considering the easiness for explanation so that they may be different from actual names.

When classifying by the liquid crystal material mode, the LCD according to the present disclosure can be categorized in TN (Twisted Nematic) mode, VA (Vertical Alignment) mode, IPS (In Plane Switching) mode, FFS (Fringe Field Switching) mode and so on. When classifying by the characteristics of transmittance vs voltage, it can be categorized in the NW (Normally White) mode and the NB (Normally Black) mode. In addition, the LCD according to the present disclosure can be any type of LCD device such as the transmissive type LCD, the semi-transmissive type LCD, and the reflective type LCD.

Figure 1:
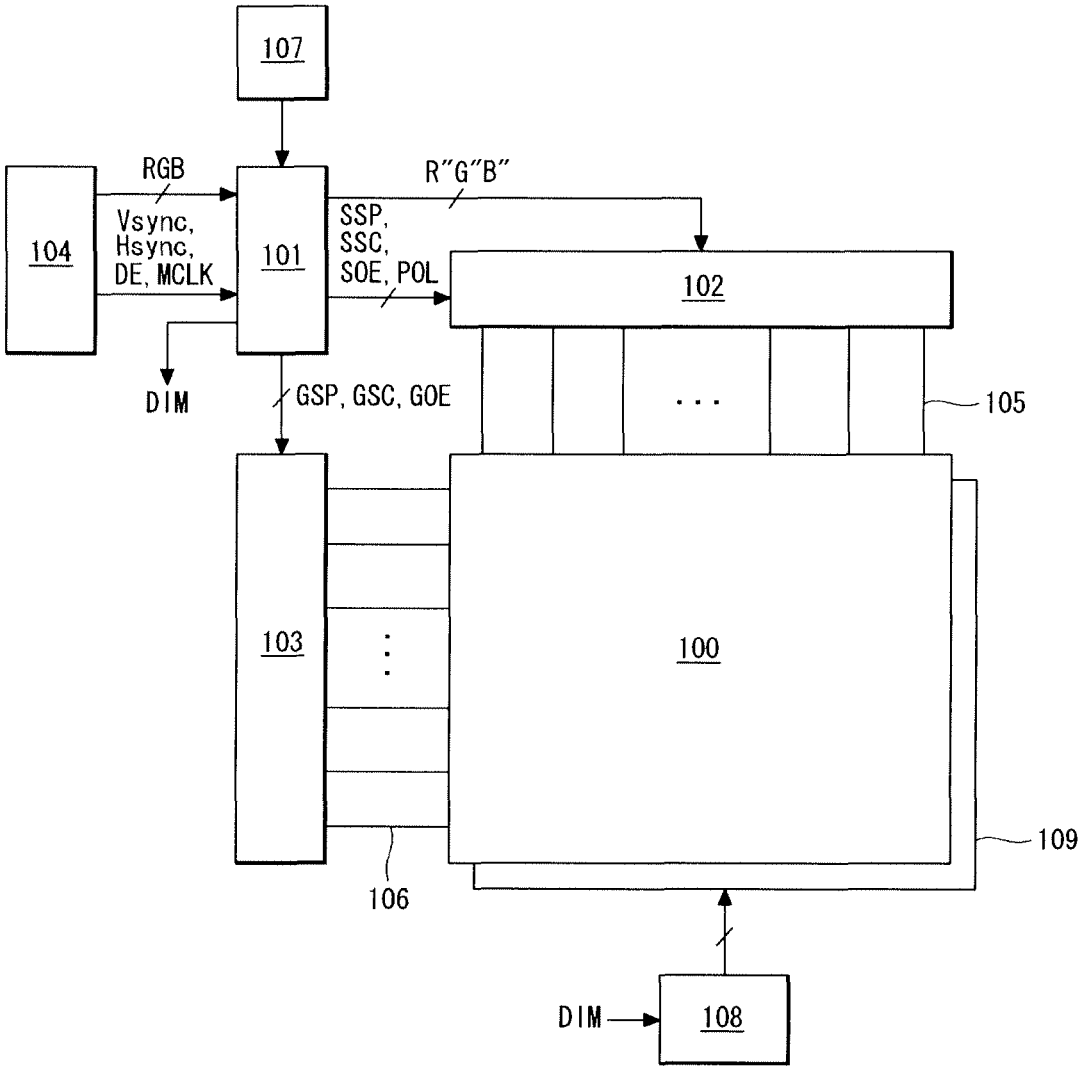
FIG. 1 is a block diagram illustrating a liquid crystal display device according to an embodiment of the present disclosure.

Referring to FIG. 1, the LCD according to a preferred embodiment of the present disclosure comprises a liquid crystal display panel 100, a back light unit 109, a backlight driving circuit 108, a timing controller 101, a data driving circuit 102, a gate driving circuit 103, and a host computer 104. The liquid crystal panel 100 comprises two glass substrates joining each other and a liquid crystal layer disposed between the two glass substrates. The liquid crystal layer includes a plurality of liquid crystal cells disposed in matrix type defined by the crossing structure of the data lines 105 and the gate lines 106.

On the lower glass substrate of the liquid crystal display panel 100, a pixel array is formed. The pixel array includes a plurality of data lines 105, a plurality of gate lines 105, a plurality of thin film transistors (or "TFT") and storage capacitors (Cst). The liquid crystal cells are driving by the electric field applied between a pixel electrode connected to the TFT and a common electrode.

On the upper glass substrate of the liquid crystal display panel 100, a color filter array including black matrixes and color filters is formed. For the vertical electric field driving type LCD such as the TN mode or the VA mode, a common electrode is formed on the upper glass substrate. For the horizontal electric field driving type such as the IPS mode or the FFS mode, the common electrode is formed on the lower glass substrate with the pixel electrode. At the each outside of the upper glass substrate and the lower glass substrate, an upper polarizer and a lower polarizer are attached, respectively. At the each inside of the upper glass substrate and the lower glass substrate, alignment layers are formed for setting the pre-tilt angle of the liquid crystal layer.

The backlight unit 109 is disposed under the LCD panel 100. The backlight unit 109 includes a plurality of light sources which can be turn on and off by the backlight driving circuit 108, for radiating the backlight to the LCD panel 100. The backlight unit 109 can be a direct type backlight unit or an edge type backlight unit. The light source of the backlight unit 109 can include at least one of HCFL (Hot Cathode Fluorescent Lamp), CCFL (Cold Cathode Fluorescent Lamp), EEFL (External Electrode Fluorescent Lamp), and LED (Light Emitting Diode). The backlight driving circuit 108 turns on and off the light source of the backlight unit 109 with PWM (Pulse Width Modulation) method by responding to the backlight dimming data (or "DIM") which is input from the timing controller 101.

The timing controller 101 receives the digital video data R, G, and B from the host computer 104 via an interface such as LVDS (Low Voltage Differential Signaling) interface or TMDS (Transition Minimized Differential Signaling) interface. The timing controller 101 modulates the digital video data R, G, and B input from the host computer 104 according to the algorithm operated by the software, compensates the color temperature according to the color compensating algorithm, and then sends the modulated and compensated data R", G" and B" to the data driving circuit 102.

The timing controller 101 also receives the timing signals including the vertical synchronizing signal (Vsnyc), the horizontal synchronizing signal (Hsync), the data enable signal (DE), the main clock signal (MCLK) and so on, from the host computer 104 via the LVDS or TMDS interfaces. Referring to the timing information stored in a non-volatile memory 107, the timing controller 101 generates a timing control signals for controlling the operating timing of the data driving circuit 102 and the gate driving circuit 103 based on the timing signals received from the host computer 104. The timing control signals includes a gate timing control signal for controlling the operating time of the gate driving circuit 103, and a data timing control signal for controlling the operating timing of the data driving circuit 102 and the polarity of the data voltage.

The timing controller 101 can drive the LCD panel 100 with the frame frequency of (60×i) Hz by multiplying the factor i (i=integer number equal or larger than 2) to the frame frequency of 60 Hz.

The gate timing control signal includes the gate start pulse (GSP), the gate shift clock (GSC), and the gate output enable signal (GOE). The gate start pulse (GSP) is applied to the gate drive IC (or "integrated circuit") generating the first gate pulse to control the shift start timing of the gate drive IC. The gate shift clock (GSC), as the clock signal input to the gate ICs commonly, is the clock signal for shifting the gate start pulse (GSP). The gate output enable signal (GOE) controls the output timings of the gate driving ICs.

The data timing control signal includes the source start pulse (SSP), the source sampling clock (SSC), the polarity control signal (POL), and the source output enable signal (SOE). The source start pulse (SSP) is applied to the source drive IC which will be sampling the first pixel data among the source drive ICs of the data driving circuit 102 to control the shift start timing. The source sampling clock (SSC) is the clock signal for controlling the data sampling timing in the data driving circuit 102 based on rising or falling edge. The polarity control signal (POL) controls the polarity of the data voltage output from the source drive ICs of the data driving circuit 102. If the digital video data to be input into the data driving circuit 102 is sent as being complied with the mini LVDS (Low Voltage Differential Signaling) interface specification, the source start pulse (SSP) and the source sampling clock (SSC) may not be used.

In the non-volatile memory 107, the timing information, a first look-up table for modulating the data, a second look-up table for selecting the backlight dimming data, and a third look-up table for compensating the color temperature. The non-volatile memory 107 may be the updatable read-only memory (ROM) such as EEPROM (Electrically Erasable Programmable Read-Only Memory).

In order to improve the video quality or the electric consumption of the AMLCD, the timing controller 101 can comprise a data modulator for modulating the gray scale of the video data, a color temperature compensator for compensating the color temperature of the video data, and a backlight controller for controlling the backlight brightness.

The data driving circuit 102 comprises one or more source drive ICs. Each source drive IC includes the shift register, the latch, the digital-analog converter, and the output buffer. The source drive ICs latch the digital video data R", G", and B" under the controlling of the timing controller 101. The source drive ICs changes the digital video data R", G", and B" convert into both an analog positive data voltage using a positive gamma compensation voltage and an analog negative data voltage using a negative gamma compensation voltage. Each of the source drive IC is connected to the data line of the LCD panel 100 by the COG (Chip On Glass) process or the TAB (Tape Automated Bonding) process.

The gate driving circuit 103 comprises one or more gate drive ICs. Each gate drive IC includes the shift register, the level shifter, and the output buffer. The gate drive ICs supply the gate pulse (or scan pulse) to the gate lines 106 sequentially by responding to the gate timing control signals. The gate drive ICs of the gate driving circuit 103 can be connected to the gate lines of the lower glass substrate of the LCD panel 100 by the TAB process or can be directly formed on lower glass substrate of the LCD panel 100 by the GIP (Gate In Panel) process.

Figure 2:
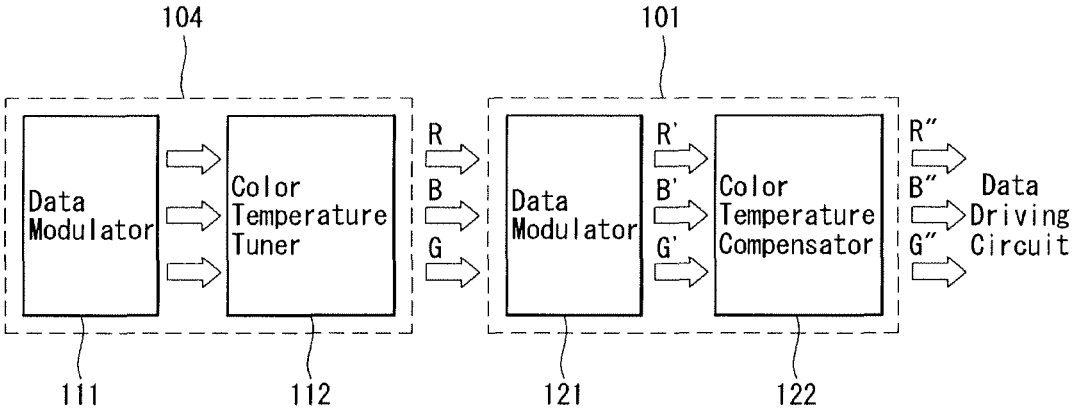
FIG. 2 is a block diagram illustrating a color temperature tuner of the host computer, and a data modulator and a color temperature compensator of the timing controller.

The host computer 104 sends the digital video data R, G, and B, and the timing signals (Vsync, Hsync, DE, and CLK) to the timing controller 101 via the interface such as LVDS interface or TMDS interface. FIG. 2 is a block diagram illustrating the configuration of the host computer 104 and the timing controller 101 according to the present disclosure.

Referring to FIG. 2, the host computer 104 comprises a data modulator 111, and a color temperature tuner 112. The data modulator 111 modulates the input video data according to the pre-set software and/or hardware algorithms. The color temperature tuner 112 tunes the color temperature of the input video data to hay the optimized color temperature. The data modulator 111 may not be included in the host computer 104, if required.

The timing controller 101 comprises a data modulator 121, and a color temperature compensator 122. The data modulator 121 modulates the input video data R, G and B according to the algorithms such as the liquid crystal response characteristic improving algorithm, the contrast ratio enhancing algorithm, the favor color compensating algorithm, and the electric consumption improving algorithm. The data modulator 121 can modulates the input video data R, G and B using a look-up table having the modulating values. The data modulator 121 can calculate a representative value of the input data and then selects the backlight dimming data according to the representative value. The data modulator 121 can modulate the input video data one or more times according to the algorithms processing steps.

The color temperature compensator 122 compensates the color temperature mismatched by the shift of the gray scale of the modulated data R', G' and B' by the data modulator 121. The algorithms of the color temperature compensator 122 may be varied according to the data modulating method of the data modulator 121. The color temperature compensator 122 can use a look-up table to compensate the color temperature. As the color temperature compensator 122 should compensate the shifted color temperature during the data modulating process, the color temperature compensator 122 has to be located after the data modulator 121. As a result, the timing controller sends the modulated and compensated data R", G" and B" to the data driving circuit 102. That is, no other data modulating process which may cause the shift of the color temperature exists between the color temperature compensator 122 of the timing controller 101 and the data driving circuit 102 to prevent the color temperature from being shifted again.

While the embodiment of the present invention has been described in detail with reference to the drawings, it will be understood by those skilled in the art that the invention can be implemented in other specific forms without changing the technical spirit or essential features of the invention. Therefore, it should be noted that the forgoing embodiments are merely illustrative in all aspects and are not to be construed as limiting the invention. The scope of the invention is defined by the appended claims rather than the detailed description of the invention. All changes or modifications or their equivalents made within the meanings and scope of the claims should be construed as falling within the scope of the invention.

What is claimed is:

1. A liquid crystal display device comprising:

a liquid crystal display panel including a plurality of data lines and a plurality of gate lines crossing each other;

a data driving circuit converting digital video data into positive and negative data voltages and supplying the positive and the negative data voltages to the plurality of data lines;

a gate driving circuit supplying a gate pulse to the plurality of gate lines sequentially;

a timing controller configured to send the digital video data to the data driving circuit, and to control operating timings of the data driving circuit and the gate driving circuit based on timing signals;

a first data modulator configured to modulate an input video data; and a color temperature tuner configured to tune a color temperature of the modulated input data, and to output the tuned input video data to the timing controller, wherein the timing controller modulates an input digital video data according to at least one of a liquid crystal response characteristic improving algorithm, a contrast ratio enhancing algorithm, a favor color compensating algorithm, and an electric consumption improving algorithm, compensates the color temperature of the input digital video data having a shifted color temperature according to the data modulating algorithm, and then sends the compensated digital video data to the data driving circuit, wherein the timing controller includes:

a second data modulator configured to modulate the input digital video data; and a color temperature compensator configured to compensate a color temperature mismatched of the modulated data by the second data modulator, and wherein a data modulating process does not exist between the color temperature compensator of the timing controller and the data driving circuit.

2. The liquid crystal display device according to the claim 1, further comprising:

a backlight unit radiating backlight to the liquid crystal display panel; and a backlight driving circuit turning on and off light sources of the backlight unit according to a backlight dimming data.

3. The liquid crystal display device according to the claim 2, wherein the timing controller calculates a representative value of the input digital video data, and selects the backlight dimming data according to the representative value.

4. A method for compensating a color temperature of a liquid crystal display device having a liquid crystal display panel including a plurality of data lines and a plurality of gate lines crossing each other, a data driving circuit converting digital video data into positive and negative data voltages and supplying the positive and the negative data voltages to the plurality of data lines, and a gate driving circuit supplying a gate pulse to the plurality of gate lines sequentially, comprising:

tuning the color temperature of the digital video data input to a host computer and then outputting timing signals and the digital video data having the tuned color temperature; and modulating the digital video data input from the host computer according to at least one of a liquid crystal response characteristic improving algorithm, a contrast ratio enhancing algorithm, a favor color compensating algorithm, and an electric consumption improving algorithm, compensating the color temperature of the digital video data having a shifted color temperature according to the data modulating algorithm, and then sending the digital data to the data driving circuit, and wherein the tuning includes modulating an input video data, and tuning a color temperature of the modulated input video data, and the modulating the digital video data includes modulating the tuned video data after the tuning the color temperature of the modulated input video data, and compensating a color temperature mismatched of the modulated data after the modulating the tuned video data, and wherein a data modulating process does not exist between a color temperature compensator of a timing controller that performs the compensating the color temperature and the data driving circuit.

* * * * *